US007665165B2

(12) United States Patent
Maganov

(10) Patent No.: US 7,665,165 B2
(45) Date of Patent: Feb. 23, 2010

(54) SHAPED EXERCISE CUSHION

(76) Inventor: Helen Pia Maganov, 35 Kinnoull Grove, Glen Waverley (AU) 3150

( * ) Notice: Subject to any disclaimer, the term of this patent is extended or adjusted under 35 U.S.C. 154(b) by 142 days.

(21) Appl. No.: 12/049,846

(22) Filed: Mar. 17, 2008

(65) Prior Publication Data

US 2009/0229048 A1 Sep. 17, 2009

(51) Int. Cl.
*A47G 9/06* (2006.01)
*A47C 27/14* (2006.01)

(52) U.S. Cl. ..... 5/419; 5/420; 482/130; 482/142; 128/845

(58) Field of Classification Search ..... 5/419, 5/420, 632, 417, 636; 482/130, 142, 23; 128/845

See application file for complete search history.

(56) References Cited

U.S. PATENT DOCUMENTS

| | | | | |
|---|---|---|---|---|
| 1,904,039 | A * | 4/1933 | Bruder | 606/240 |
| 4,850,603 | A * | 7/1989 | Haaland | 277/630 |
| 5,474,513 | A * | 12/1995 | Carlesimo et al. | 482/140 |
| 5,632,050 | A * | 5/1997 | Zajas et al. | 5/632 |
| 5,774,916 | A * | 7/1998 | Kurhi | 5/632 |
| 6,921,372 | B2 * | 7/2005 | Shin | 601/134 |

* cited by examiner

*Primary Examiner*—Alexander Grosz
(74) *Attorney, Agent, or Firm*—Holland & Hart LLP

(57) ABSTRACT

There is disclosed an exercise cushion (10) for at least partially supporting an individual on a substantially level support surface (8). The cushion 10 comprises a body configured to elevate a region extending from and including the head to the thoracic spine of the individual from the substantially level support surface (8).

9 Claims, 1 Drawing Sheet

SHAPED EXERCISE CUSHION

FIELD OF THE INVENTION

The present application relates to an exercise device and a method of using the exercise device. More particularly, the present invention relates to an exercise cushion or mat for exercising and a method of using the cushion or mat.

BACKGROUND OF THE INVENTION

Floor-based exercise is an important form of exercise for many individuals seeking to build body strength and improve fitness. Popular forms of such floor-based exercise are Pilates and yoga, and classes are often conducted on a horizontal surface such as a floor or ground.

Exercise mats are often used by individuals attending such exercise classes to be placed on the floor to cushion the individual's body from the hardness of ground or the floor's surface. Conventional exercise mats are flat and sized to accommodate a user's body without taking up too much floor space. Conventional mats are often rectangular in shape and relatively thin such that they can be rolled up and conveniently carried by the individual.

With conventional flat exercise mats, when the user is lying in a supine position, namely lying on their back with their face up, their head, neck and upper back are flat on the floor and are in a position that replicates a standing position. In this position, the spine's preferred position may be referred to as 'static spine' meaning that the back is being held with natural curves of the spine in place using muscles such as the Transverse Abdominal muscle (TA) and multifidus. It is considered that the "static spine" position, when translated into an upright stance, will only provide appropriate muscle conditioning for a 'static spine', namely standing still.

It is well established that during normal upright movement, such as fast walking, running or jumping, the upright upper body pitches slightly forward. In particular, when initiating movements such as fast walking, running and jumping, the upper half of the spine is slightly pitched forward from the hips, a position that can be referred to as 'dynamic spine'.

As the 'static spine' position doesn't replicate the forward pitch of the upper body in the 'dynamic spine' position, exercise on conventional flat exercise mats does not allow an individual to effectively exercise postural muscles, which are used when running or jumping. Hence, athletes that run and jump are unable to fully benefit from using conventional flat exercise mats in their workouts, particularly if they are performing exercises to strengthen abdominal and back muscles in a lying or horizontal position.

Thus, there is a need to provide an exercise mat or cushion that can be used by an individual in a lying or horizontal position, as well as a vertical position, that replicates the forward pitch of the upper body during upright movement so as to more effectively target and strengthen specific muscle groups.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

SUMMARY OF THE INVENTION

According to the present invention, there is provided an exercise cushion for at least partially supporting an individual on a substantially level support surface, comprising: a body configured to elevate a region extending from and including the head to the thoracic spine of the individual from the substantially level support surface.

In one embodiment, the body comprises a first portion for supporting and elevating an upper back region of the individual from the substantially level support surface, and a second portion for supporting and elevating the head and neck region of the individual from the substantially level support surface.

The first portion may comprise a thoracic spine support component for receiving and supporting the thoracic spine of the individual. The thoracic spine support component may comprise a substantially horizontal planar surface elevated from the substantially level support surface. The substantially horizontal planar surface of the thoracic spine support component may be elevated from the substantially level support surface between about 10-30 mm.

The first portion may further comprise a shoulder support component for receiving and supporting the shoulders of the individual. The shoulder support component may comprise an inclined surface extending from the substantially planar surface of the thoracic spine support component that is elevated from the substantially level support surface. The inclined surface of the shoulder support component may be elevated from the substantially level support surface at a maximum elevation of between 50-90 mm.

The second portion may comprise a neck support component for receiving and supporting the neck of the individual. The neck support component may comprise an inclined surface that extends from the inclined surface of the shoulder support component such that the inclined surface of the neck support component is elevated a greater distance from the substantially level support surface than the inclined surface of the shoulder support component. The inclined surface of the neck support component may have an angle of elevation less than or substantially equal to the inclined surface of the shoulder support component. The inclined surface of the neck support component may be elevated a maximum distance of between 60-110 mm from the substantially level support surface.

The second portion may further comprise a head support component for receiving and supporting the head of the individual. In one form, the head support component may comprise a declined surface extending from the inclined surface of the neck support component to a substantially horizontal surface. The substantially horizontal surface may be elevated a distance of between 40-120 mm from the substantially level support surface. In another form, the head support component may comprise a horizontal surface extending from the inclined surface of the neck support component. In this form, the horizontal surface may be elevated a distance of between 40-120 mm from the substantially level support surface.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF DESCRIPTION OF THE DRAWINGS

By way of example only, the invention is now described with reference to the accompanying drawings.

DETAILED DESCRIPTION OF THE INVENTION

Figure 1:
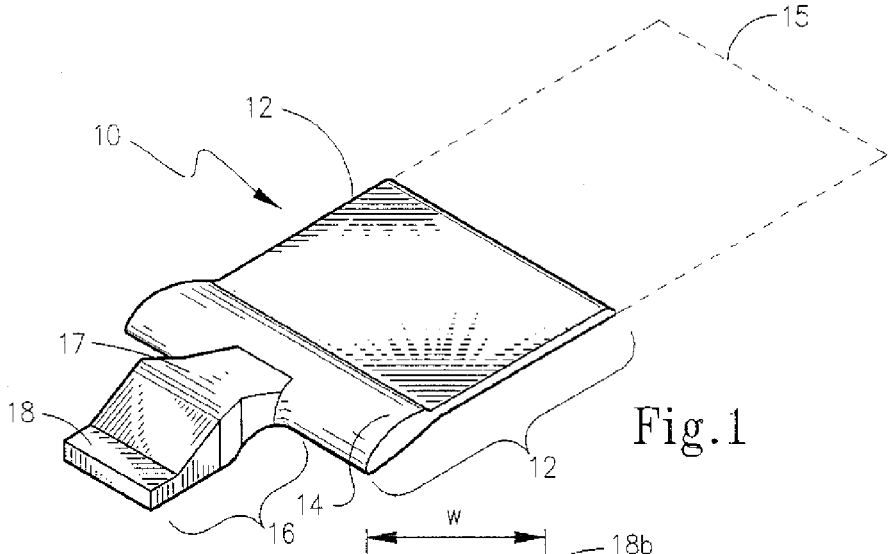
FIG. 1 is a perspective view an exercise mat in accordance with one embodiment of the present invention.
Figure 2:
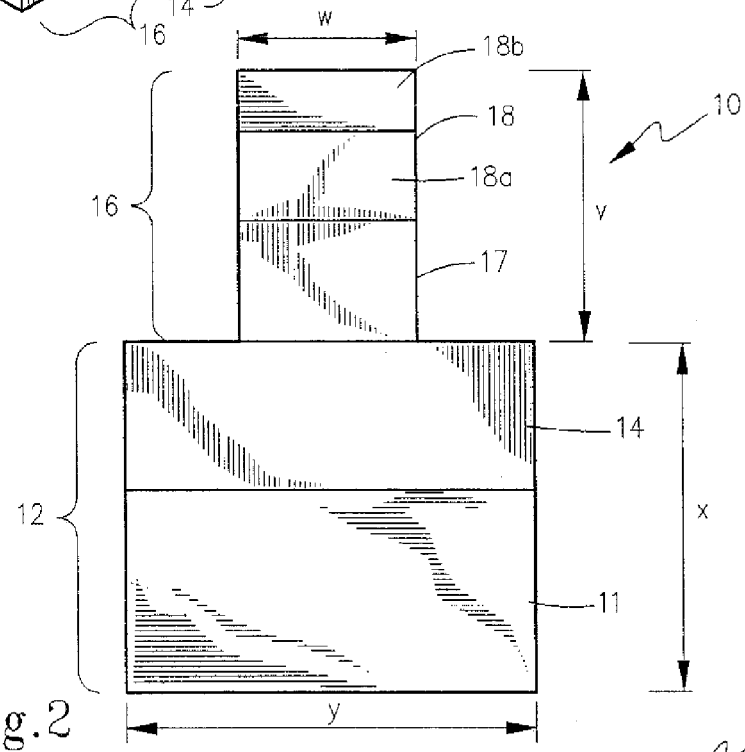
FIG. 2 is a top view of the upper region of an exercise mat in accordance with another embodiment of the present invention.
Figure 3:
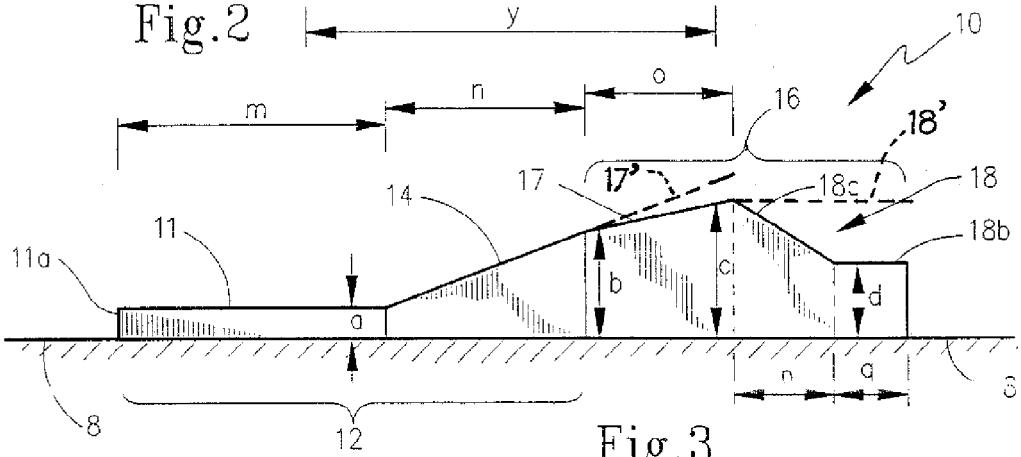
FIG. 3 is a side view of the upper region of the exercise mat as shown in FIG. 2.

Two embodiments of the mat/cushion 10 of the present invention are shown in FIGS. 1-3. The present invention will be shown and described in relation to a cushion 10 to be placed under the upper extremity of an individual as they lay, or are otherwise supported, upon a flat surface. However, it will also be appreciated that the present invention could be in the form of a mat that is placed over a flat surface to support the individual thereon. The flat surface may be a substantially horizontal surface or a substantially vertical surface.

As is shown, the cushion 10 is configured to be positioned on a support surface 8, such as a floor, wall or the like, to support the individual during an exercise session. The cushion 10 comprises two main portions: an upper back support portion 12 and a head and neck support portion 16.

The upper back support portion 12 has a width (y) of between 300-450 mm, preferably 350 mm, and a length (x) of between 280-340 mm, preferably 320 mm and comprises two regions: a thoracic spine support region 11 for supporting the thoracic spine of the individual, and a shoulder support region 14 for supporting the shoulder area of the individual.

As is shown more clearly in FIG. 3, the thoracic spine support region 11 is in the form of a length of cushion 10 raised from the support surface 8. The thoracic spine support region 11 is shown as being substantially flat length of cushion 10 having a length (m) of between 160-200 mm, preferably around 180 mm. The thickness (a) of the thoracic spine support region 11 may be between 10-30 mm, preferably 20 mm. It will be appreciated that the thoracic spine support region 11 may be slightly angled towards the shoulder support region 14 such that its thickness (a) is not constant along the length of the thoracic spine support region 11. The thoracic spine support region 11 acts to support the individual's thoracic spine such that it is lifted off the support surface 8 to simulate a slight forward lean of the back. Further, the free end 11*a* of the thoracic spine support region 11 may be tapered towards the support surface 8, as shown in FIG. 1, rather than being stepped as shown in FIG. 3.

The shoulder support region 14 is a region of the cushion 10 that extends across the shoulder region of the individual to support the shoulders. As shown in FIG. 3, the shoulder support region 14 is inclined upwardly with respect to the thoracic spine support region 11 at an angle such that the individual's shoulders are supported further beyond the support surface 8 than the individual's thoracic spine. The shoulder support region 14 may extend a length (n) of between 120-160 mm, preferably 140 mm. The shoulder support region 14 is shown as being a substantially planar surface in FIG. 3, however, the shoulder support region 14 may be curved, as is shown in FIG. 1. The thickness (b) of the shoulder support region 14 at its distal end may be between 50-90 mm, preferably around 70 mm.

It will be appreciated that the upper back support portion 12 acts to elevate the thoracic spine and the shoulder region of the individual from the flat support surface 8. In this regard, the shoulder region is elevated slightly further from the support surface 8 than the individual's thoracic spine region to replicate the forward pitch of the individual's body when walking, running, jumping.

The head and neck support portion 16 comprises a neck support region 17 and a head support region 18. In the embodiment as shown in FIGS. 1-3, the head and neck support portion 16 has a width (w) of between 120-170 mm, preferably 150 mm and a length (v) of between 200-240 mm, preferably 220 mm. As such, the head and neck support portion 16 is shown as being narrower than the upper back support portion 12, however, it will be appreciated that the widths of the head and neck support portion 16 and the upper back support portion 12 may be substantially the same.

The neck support region 17 is in the form of a planar surface having an angle of inclination less than the angle of inclination of the shoulder support region 14 of the upper back support region 12. In this regard, the neck support region 17 extends for a length (o) of between 90-110 mm, preferably 100 mm, and receives and supports the neck and cervical spine of the individual. The individual positions themselves on the cushion 10 such that the nape of the neck is located on the end of the neck support region 17, namely the most distal point of elevation of the cushion 10. At this point, the thickness (c) of the neck support region 17 is between 60-120 mm, preferably 90 mm. In this position, the individual's neck is elevated from the support surface 8 beyond that of the user's shoulders and thoracic spine. It will be appreciated that in another embodiment, shown in broken line in FIG. 3, the angle of inclination of the planar surface of the neck support region 17' may be substantially the same as the angle of inclination of the shoulder support region 14.

The head support region 18 is a two-part region of the cushion 10 comprising a downwardly angled surface 18*a* and a substantially horizontal surface 18*b*. The downwardly angled surface 18*a* extends for a length (p) of between 60-120 mm, preferably 70 mm, from the end of the neck support region 17 to the substantially horizontal surface 18*b*. The downwardly angled surface 18*a* supports the head of the individual in a manner that is tilted back from the neck. This position represents a position consistent with good posture. The substantially horizontal surface 18*b* extends for a distance (q) of between 40-80 mm, preferably 50 mm and has a thickness (d) of between 40-120 mm, preferably 50 mm. It will be appreciated from FIG. 3, that the individual's head, when supported on the cushion 10, will be elevated from the support surface a degree greater than the degree of elevation of the individual's thoracic spine.

In an alternative embodiment (shown in broken line in FIG. 3), the head support region 18' may be a single horizontal surface extending from the end of the neck support region. In this arrangement, the individual's head is supported on the horizontal surface such that it is tilted back from the angle at which the individual's neck is supported.

The cushion 10 acts to lift and support the specific regions of the individual's body from a horizontal position to a slightly pitched forward position to replicate the forward pitch of the body when walking, running or jumping.

It will be appreciated that the cushion 10 may assume a variety of sizes and dimensions to accommodate a variety of individuals of different sizes and shapes. It will also be appreciated that the cushion 10 may be used in junction with Pilates and other such equipment, such as the Cadillac/Trap Table and Reformer, and may be used against a wall.

As will be described below, the cushion 10 may be used by an individual/athlete to exercise postural muscles that are used when walking, running or jumping more effectively, even though they are in a lying or horizontal position. As the cushion 10 ensures that the individual's spine and upper body is pitched forward in the alignment that it would be in should the individual be walking, running or jumping, the cushion 10 enables floor-based exercise routines which are more specific to the individuals required functions.

Six specific exercises prescribed to be performed with the cushion 10 by any athlete without additional equipment are described below. Each exercise is progressively more demanding and in use, it is recommended that the athlete master the earlier exercise before attempting the subsequent one. It will be appreciated that other exercises may also be performed by the individual with the cushion 10 and still fall within the spirit of the present invention.

For all the exercises described below, placement of the individual's body on the cushion 10 is crucial. In this regard, the individual's shoulders should be supported on the slanted shoulder region 14 of the cushion 10 and the neck positioned on the curved neck support region 16.

Exercise 1. Introduction to Supporting the Lumbar Spine when Using Cushion 10

In this exercise, the individual positions themselves on the cushion 10 so that the nape of their neck (vertebra C1-C2) is over the highest point of the neck support region 14 and their shoulders rest on the shoulder region 14. The position of the head is more important than lining up the shoulders with the shoulder support region 14. In this position the individual's neck should be comfortable and their shoulders be well supported.

The individual then bends their legs so that their heels are approximately 25-30 cm from their hips and their feet are hip width apart. In this position the feet and knees should not be together. The individual's head, neck and shoulders should then be allowed to relax and any tension in the rib cage should be noticed. The rib cage should then be allowed to soften so that it feels like it is melting into the floor. The position of the individual's lumbar spine/lower back should then be noticed. In this position, the hips should not be relaxed with the lumbar spine and hip area resting on the support surface, rather the front hip bones should be parallel to the floor with a slight arch in the lumbar spine. When in this position, the individual should feel their coccyx bone applying a pressure to the support surface 8. This is known as the 'Basic Position'.

In the 'Basic Position', pelvic floor muscle group and the lower abdominal muscle Transverse Abdominous (TA) should be drawn in by the individual and the muscle in the pelvic and hip area should be felt to become firm and tighten. At this stage, no tension should be felt in any other part of the body such as shoulders or ribcage. The hip position should not change. ie. the hips should not tip or roll. The individual should then hold the muscles on for the count of 4, which can be increased to a count of 12 with practice. The lower abdominal muscles can then be relaxed. The tightening and relaxing of the muscles can then be repeated for a further 10 times.

Exercise 2. Basic Exercise: Single Leg Extension

For this exercise, the individual should start in 'Basic Position' as described above in Exercise 1.

The individual then draws in the pelvic floor and TA muscles to ensure their lower back is kept still (there should be no additional arching or tipping) and with a free breath (ie. either inhaling or exhaling, but not holding breath) and maintaining tension on the pelvic floor and TA, individual slides one leg out along the floor so that it remains in line with their body. The individual then returns this leg back to its original bent knee position. The individual then slides the other leg out along the floor and returns it to the bent knee position. The main focus of the exercise is that the individual keeps their hips still and their upper body relaxed as their legs move. Alternate legs up to 8 times. The exercise can be performed slowly or quickly.

Exercise 3. Basic Exercise: Single Leg In

For this exercise, the individual starts in the 'Basic Position' as described above in Exercise 1. In this position the individual should feel relaxed in the shoulder area but control in the hip area. They should extend one leg, and then the other, out along the floor such that the legs are extended but the lower back or hip does move during the extension process. This is the exercising position for this exercise.

The pelvic floor and TA muscles are then drawn in to ensure the lower back is still and in correct alignment (there should be no arching of the lower back or tipping of the hips). With a free breath and maintaining tension on the pelvic floor and TA, one leg is slid along the floor to bring it towards the hip so that it is bent and about 25 cm away from the buttocks. This leg is then straightened again.

The individual may choose to do this exercise 8 times on one leg and then 8 times on their other leg or alternate legs 8 times each. The main focus of the exercise is that the individual keeps their hips still and their upper body relaxed as their legs move.

Exercise 4. Intermediate Exercise: Single leg Raise to 90/90

For this exercise, the individual starts in the 'Basic Position' as described above in Exercise 1. The individual should feel relaxed in their shoulder area but control in their hip area. One leg should be initially extended, and then the other, out along the floor. This position is the exercising position for this exercise.

From this starting position, the individual brings one leg up towards their body bending the knee and stopping the leg such that the knee is maintained bent at a 90 degree angle, the thigh held at a 90 angle above the hip and the lower leg parallel to the floor. This position can be referred to as position '90/90' as the angle of the thigh is 90 degrees to the hip and the lower leg is at 90 degrees to the thigh. The thigh should be directly in line with its supporting hip joint and the position of the lower back and hips should not move from Basic Position.

The individual then lowers their leg to the floor such that it is in a lengthened/straight position out in front. The individual may choose to do this exercise 8 times on one leg and then 8 times on the other leg, or alternate legs 8 times each. The main focus of the exercise is that the individual keeps their hips still and their upper body relaxed as their legs move.

Exercise 5. Intermediate Exercise: Leg Switch

For this exercise, the individual starts in the 'Basic Position' as described above in Exercise 1. Once again, the individual should feel relaxed in their shoulder area but controlled in their hip area. One leg should be initially extended, and then the other, out along the floor. This position is the exercising position for this exercise.

When in this position, the individual should draw in their pelvic floor and TA muscles to ensure their lower back is still and in correct alignment. With a free breath, and maintaining tension on the pelvic floor and TA, the individual slides one leg along the floor to bring it towards their hip so that it is about 25 cm away from their buttocks. The individual then begins to straighten this leg again. As this leg begins to straighten, the individual slides the other leg along the floor to bring it towards the hip so that it is about 25 cm away from their buttocks. The individual continues to move the legs back and forward for around twenty times. The action is similar to riding a bike but the feet remain in contact with the floor and the hips should not move with the leg action. Hence, the hips should remain still and only the legs should move.

Exercise 6. Advanced Exercise: Raised Leg Switch

For this exercise the individual should begin as in Exercise 4, with their upper body on the cushion 10 and their lower back supported by the abdominal and back muscles, with their legs extended out along the floor.

As with Exercise 5, the legs should be alternating but in this instance, the bent leg should be off the ground.

From the starting position, the individual brings one leg up towards their body bending their knee, so that it is positioned with the knee bent at a 90 degree angle. The individual then keeps their thigh at a 90 angle above their hip, with their lower leg being parallel to the floor in the "90/90 position". The thigh should be directly over its supporting hip joint and the hips should have not moved from the 'Basic Position'.

The raised leg is then lengthened whilst it is kept off the ground, as if along an imaginary table top the same height of the lower leg when it was held in the '90/90 position'. As this leg is lengthened, the other leg is brought up to '90/90 position'. The individual should keep alternating their legs, holding their legs off the ground throughout the exercise for around 10 leg changes.

In each of the exercises described above, if the individual feels their hip or back position changing from Basic Position, their shoulders tensing, their rib cage lifting off the cushion 10, or their neck muscles tightening, the exercise should be stopped. The aim of each exercise is to tone the individual's abdominal and back muscles without upper body tension. Hence, if tension occurs in the upper body it is because the exercise demands too much from the individual's abdominal and back muscles. A simpler exercise should be performed until the muscles become stronger.

It will be appreciated that the cushion 10 of the present invention can be used by athletes specialising in running and jumping activities in their floor based exercise routines to strengthen abdominal and back muscles. The shape of the cushion 10 allows such athletes to exercise postural muscles, which are used when running or jumping, in a lying or horizontal position more effectively, as the spine is positioned in the alignment that it would be when they are running or jumping. Thus lying on the shaped cushion makes the exercises more specific for the required function.

The cushion 10 may be made from an open or closed cell foam material having a variety of densities. The foam material may be polyurethane, although other materials are also envisaged. The cushion 10 may be cut from one or more pieces of foam material and assembled to form the desired cushion shape, or the cushion 10 may be moulded to assume the desired shape. It will be appreciated that the cushion 10 may be finished by rounding the edges or by providing one or more covers over the cushion 10.

It will also be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. An exercise cushion for at least partially supporting an individual on a substantially level support surface, comprising:

a body configured to elevate a region of the individual extending from and including the head of the individual to and including the thoracic spine of the individual from the substantially level support surface, the body comprising a first portion for supporting and elevating above the substantially level support surface an upper back region of the individual, and a second portion for supporting and elevating above the substantially level support surface the head and neck region of the individual, wherein the first portion comprises a thoracic spine support component for receiving and supporting the thoracic spine of the individual, the thoracic spine support component comprising a substantially planar surface elevated from the substantially level support surface, the first portion further comprising a shoulder support component for receiving and supporting the shoulders of the individual, the shoulder support component comprising an inclined surface elevated from the substantially level support surface and extending from the substantially planar surface of the thoracic spine support component, and wherein the second portion comprises a neck support component for receiving and supporting the neck of the individual, the neck support component comprising an inclined surface that extends from the inclined surface of the shoulder support component such that the inclined surface of the neck support component is elevated a greater distance from the substantially level support surface than the inclined surface of the shoulder support component, and wherein the inclined surface of the neck support component has an angle of elevation less than or substantially the same as said inclined surface of the shoulder support component.

2. An exercise cushion according to claim 1, wherein the substantially planar surface of the thoracic spine support component is elevated from the substantially level support surface between about 10-30 mm.

3. An exercise cushion according to claim 1, wherein the inclined surface of the shoulder support component is elevated from the substantially level support surface at a maximum elevation of between 50-90 mm.

4. An exercise cushion according to claim 1, wherein the inclined surface of the neck support component is elevated a maximum distance of between 60-120 mm from the substantially level support surface.

5. An exercise cushion according to claim 1, wherein the second portion further comprises a head support component for receiving and supporting the head of the individual.

6. An exercise cushion according to claim 5, wherein the head support component comprises a declined surface extending from the inclined surface of the neck support component to a substantially horizontal surface.

7. An exercise cushion according to claim 6, wherein the substantially horizontal surface is elevated a distance of between 40-120 mm from the substantially level support surface.

8. An exercise cushion according to claim 5, wherein the head support component comprises a substantially horizontal surface extending from the inclined surface of the neck support component.

9. An exercise cushion according to claim 8, wherein the substantially horizontal surface is elevated a distance of between 40-120 mm from the substantially level support surface.

* * * * *